US005306077A

United States Patent [19]

Trevaskis

[11] Patent Number: 5,306,077

[45] Date of Patent: Apr. 26, 1994

[54] DRAWER UNIT FOR DISPLAYING AND DISPENSING OF MERCHANDISE

[75] Inventor: Thomas R. Trevaskis, Victoria, Australia

[73] Assignee: Megaspace Pty Ltd., Moorabbin, Australia

[21] Appl. No.: 955,199

[22] Filed: Oct. 5, 1992

[30] Foreign Application Priority Data

Oct. 4, 1991 [AU] Australia ..... 8744
Apr. 8, 1992 [AU] Australia ..... 1767

[51] Int. Cl.[5] ..... A47F 3/024; A47B 88/04; A47B 88/18

[52] U.S. Cl. ..... 312/122; 312/323; 312/333; 312/334.47

[58] Field of Search ..... 312/111, 330.1, 334.47, 312/334.44, 323, 322, 122, 333

[56] References Cited

U.S. PATENT DOCUMENTS

| | | | |
|---|---|---|---|
| 1,189,371 | 7/1916 | Lyons | 312/322 |
| 3,954,315 | 5/1976 | Sarden | 312/333 |
| 4,441,771 | 4/1984 | Roesler | 312/323 |
| 4,460,145 | 7/1984 | Ando | 312/322 |
| 5,048,699 | 9/1991 | Trevaskis | 211/59.2 |
| 5,147,120 | 9/1992 | Ray | 312/111 |

*Primary Examiner*—Timothy V. Eley
*Assistant Examiner*—David P. Bryant
*Attorney, Agent, or Firm*—Jacobson, Price, Holman & Stern

[57] ABSTRACT

Display dispenser for merchandise in shops, including a cabinet with inclined drawers from which articles are removed from the front, and articles to the rear slide forwards to occupy positions vacated, the drawer being simply releasable, by a single-handed movement, from its normal position, and slidable forwards to a position wherein it can be replenished without moving the other drawers and thereafter pushed back, again by a single handed movement, to automatically lock back into the normal position.

6 Claims, 3 Drawing Sheets

DRAWER UNIT FOR DISPLAYING AND DISPENSING OF MERCHANDISE

This invention relates to trays and similar containers including those movable drawer-like on or within a fixed frame or housing and supportable one above the other in or as a refrigerator cabinet or the like for displaying items e.g. merchandise such as cigarettes packaged in rectangular boxes and other objects required to be held ready for convenient dispensing from a suitably compact and visible stack, row or other arrangement.

Considerations of space usually require that such trays or drawers be relatively closely spaced in the cabinet. However this can lead to difficulties when a particular tray, other than the top tray, has to be replenished.

Our Australian patent 598710 and corresponding U.S. Pat. No. 5,048,699 disclose a cabinet with vertically spaced trays each capable of limited turning movement about a rear horizontal axis which is fixed with respect to the cabinet. In a lower or use position the plane of the tray is sufficiently declined from the horizontal to cause a front-to-rear stack of boxes to slip forwards when a purchaser removes one or more boxes from the front of the stack. The tray can be raised to an upper position for re-stocking or for raising the next lower tray. Pairs of front supports are such that each pair forwardly supports one tray in the lower position and the next lower tray in the upper position. The raising of any tray requires the prior raising of a tray next above.

Our earlier trays were such that no tray, be it full or empty of merchandise, could be moved into the upper/-lower position unless all trays above/below it were in that position. This tended to make the replenishment of the tray a somewhat cumbersome operation.

It is an object of our invention to provide a simple, versatile, modular and readily accessible and replenishable shop display stand for boxes of confectionery, cigarettes, bottles, drink cans and cartons and/or for other merchandise, combining compactness with simplicity of construction and operation.

The above and other objects and advantages will become apparent hereinafter.

Accordingly the present invention provides a drawer, a holder for said drawer, means for supporting the drawer on or in said holder and for guiding the drawer in generally translational front-to-rear movement relatively to the holder, said supporting and/or guiding means being such that at least one stage of said movement the tray is permitted to tilt under the force-couple due to its own weight and the reaction on it due to the support, thereby to lock into a position wherein said front-to-rear movement is resisted.

Advantageously the invention, in a first aspect, provides a tray capable of remaining or of being held in one of two positions in a cabinet or a stackable cabinet module which provides for a number of such trays to be supported in horizontally and/or vertically spaced relationship. The cabinet is open-fronted and may be of generally rectangular form. Each tray is supported in a suitably inclined fashion wherein it is movable substantially back-and-forth (rather than rotationally as in our earlier device) between a back (upper) normal or "use" position, and a front (lower) or "replenishing" position in which the tray projects sufficiently forwardly of its companions to enable it to be conveniently refilled i.e. from the front. Co-operable pin-and-slot or other suitable means operative between cabinet and tray, guide the tray for inclined front-to-rear translational movement, and angled, offset, return or hooked end portions of the slot(s)are adapted to receive pins when the tray is in its front and/or back positions thereby to provide an abutment to restrain the tray against movement beyond the desired position.

The guides may be slotted members attached to the respective insides of the holder. The slots can be substantially straight except for rear end portions. The supports may include two longitudinally-spaced pairs of pins on and projecting laterally from the outsides of the tray or drawer. The pins of each pair are collinear on imaginary lines transverse to the tray. The pins, when moving in the straight parts of the slots, constrain the tray to affect a linear or translational movement relative to the holder, and front and rear ends of the slots may, when the front and rear tray pins about against them, define front and rear extremities for the tray movement. Rear parts of slots may be substantially at right angles to the main parts, so that when the tray reaches the rear abutment, it can tilt about the line of the front pins as fulcrum whereby the back pins enter the rear or angled parts of the slots and lock the tray in that position until (e.g. by the user e.g. lifting the front of the tray) the tray be unlocked and permitted to move or slide towards its front position.

In another aspect, the invention provides for a tray or drawer to hold cans and/or bottles filed "upright" in a row or front-to-rear "columns", the tray or drawer being supported and guided for forward and rearward movement relatively to a holder or cabinet, between (1) a rearmost "normal" or "use" (first) position wherein the tray is sufficiently inclined to enable a row, file or column of cans, bottles or the like to slide forwards when one or some of their number is/are removed from the front, and (2) a foremost (second) position wherein the tray is sufficiently accessible for convenient restocking.

The guides and supports may be such as to turn the tray somewhat in the course of this to and fro movement.

The tray guides may be side rails fixed within the cabinet and, co-operable and fitting therewith, flanged or grooved plastics rollers rotatable on stub axles projecting from the sides of the tray. The rollers may include a first rearward pair running against the undersides of the rails and a second pair disposed somewhat forwardly of the first pair and running on top of the rails. The centre of mass of the tray, be it empty or stocked to any extent from the front, is forward of the rollers, so that the weight of the tray (plus any contents thereof) will tend to press the first and second rollers into contact with the bottom and top of the rails, respectively.

The rearward and forward extremities of the tray's movement scil. the first and second positions thereof, may be defined and located where the first and second pairs of rollers, respectively, abut against suitable stops. These may be posts or other structural parts of the cabinet.

Provision may be made for causing the tray, in the last stage of its rearward movement, automatically to lock into the first position.

This may be achieved by recessing or notching the underside of the rails to catch hub portions of the first rollers. The tray may be unlocked by raising the front, whereby it tilts about a fulcrum provided by the second rollers, to lower the first rollers from the notches, and allowing the tray to shift slightly forwards so that the rollers are clear of the notches. Apart therefrom, the tray may be moved or guided between its first and second positions by a simple fore/aft pressure by the user's hand.

If the rollers are of plastics material they are relatively soft. This, plus the inertia of the rollers themselves, may provide a braking action for the tray's forward movement, or may tend to reduce forward acceleration.

As previously indicated, the guides/supports may be such as to turn the tray somewhat e.g. by constraining the front to lift, so that in its second position the tray could be almost horizontal. Advantageously this has the effect of facilitating the return of the tray. Thus each rail may be a very shallow V, with the front substantially horizontal, or at least inclined at a lesser angle than the rear portion. Or the rails may be arcuate, again with their front portions less inclined to the horizontal than their rear positions. In the case of a V-shaped rail, the second (forward) rollers may be at about the point of the "V", or slightly forward thereof, when the tray is in the first or rearmost position.

It will be evident that if the first and second rollers are respectively below and above the rail, the front portion of the rails will need to be inclined somewhat to make the tray horizontal when in the second position.

In use, when it is desired to stock or replenish the tray according to the second aspect of the invention, it being presumed to be in the first position, its front of the tray is lifted to cause it to tilt about a "fulcrum" where the hubs of the second rollers roll on top of the respective rails. The back of the tray is lowered by this movement, so as to remove the hubs of the first rollers from their respective notches or the like underneath the back of the rails. The tray can then slide forwards although this movement, at least in the first stage, may need some restraint by the user's hand. Having reached its second or foremost position the tray is exposed for convenient re-stocking, after which it is pushed back to lock automatically into the first position, as hereinabove described.

If desired, the front of the tray may be suitably shaped e.g. in chevron formation to fit around the foremost can or bottle in each file.

But in order that the invention may be better understood reference will now be made to the accompanying drawings which are to be considered as part of this specification and read herewith. In the drawings:

FIG. 1 illustrates, for part of a stack of cabinet modules, an inside side elevation of the left walls showing elements defining walking-stick-shaped lasts associated with three successive modules according to the first aspect of the invention. The respective drawers are shown in dotted outline in three different positions. The top drawer is locked in its normal or use position. The middle drawer is in the first stage of unlocking, enabling it to slide forwardly to the foremost position demonstrated by the lowest drawer illustrated.

Figure 1:
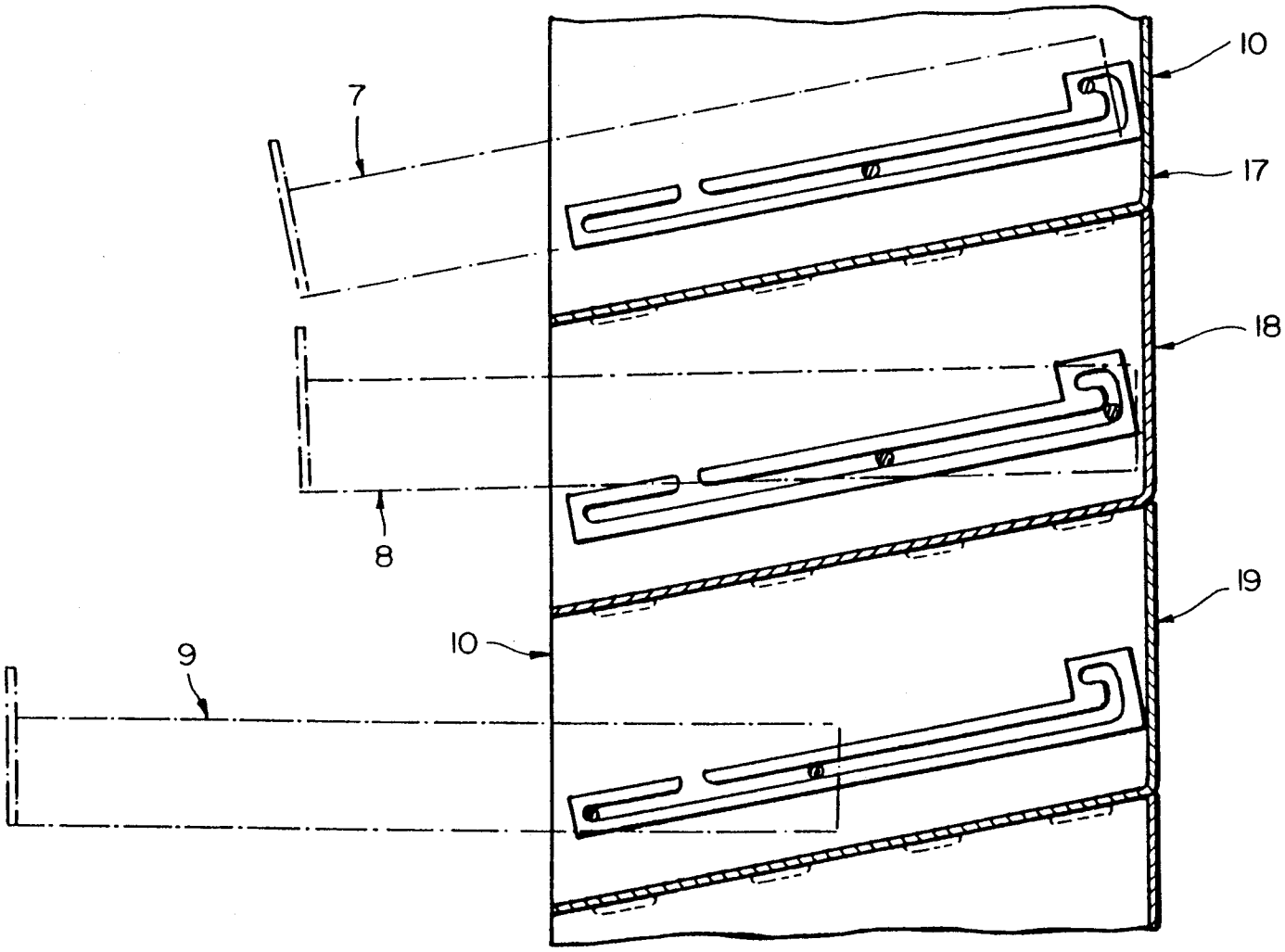
Figure 2:
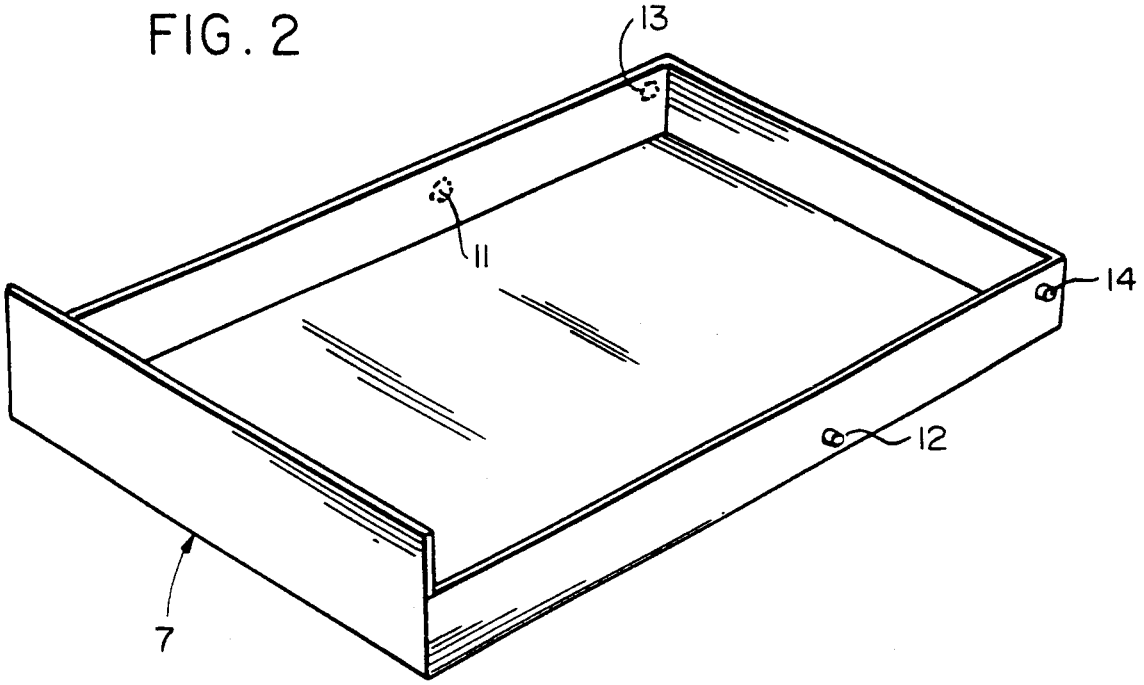
FIGS. 2 and 3 are top-right perspectives of a drawer and a cabinet module respectively, as shown in FIG. 1.

Referring to the drawings in more detail, the illustrated embodiment of the invention provides for trays or drawers 7, 8 and 9 to be supported and guided for generally translational front-to-rear movement relatively to a holder 10, by pins 11 to 14 slidable in slots 15 formed in plastics or like elements 16 affixed to each inside of a corresponding cabinet module 17 to 19. Pins 11 to 14 comprise front and rear pairs 11,12 and 13,14 respectively and project laterally from a typical drawer 7 as shown, to be received in slots such as 15 in slotted elements or blocks 16. Pins 11,12 and 13,14 are respectively collinear on imaginary lines or axes transverse to the tray.

Each slot 15 consists of an elongated straight portion 20 and a hooked end portion 21. The pins, when moving in the straight parts of their respective slots, constrain the tray to affect a substantially linear or translational movement relative to the holder, the front, lower or "replenishing" position of the drawer being reached when the front pins 11,12 abut against the front extremities of the respective slots. Similarly a rearward extremity for the motion is attained when the rear pins abut against the rearmost part of the slot.

Figure 4:
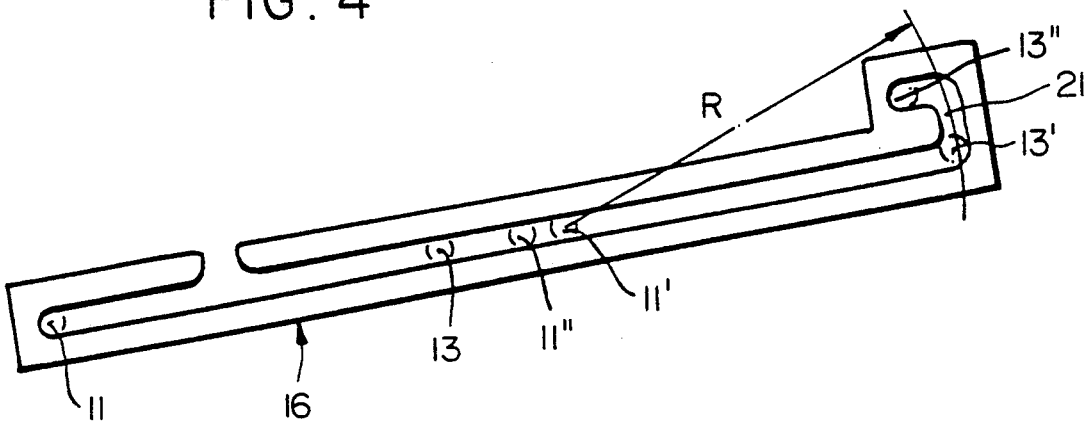
FIG. 4 is a vertical section through the groove on one side of a cabinet module showing the relative dispositions of tray pins in the three stages illustrated in FIG. 1.
Figure 5:
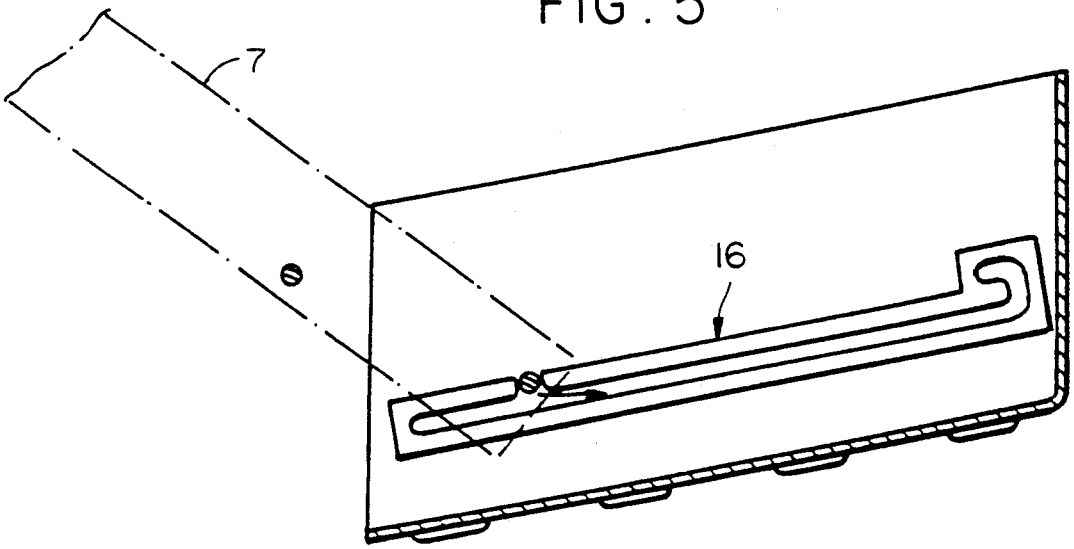
FIGS. 5 and 6 show how a drawer is initially received in its compartment module.
Figure 6:
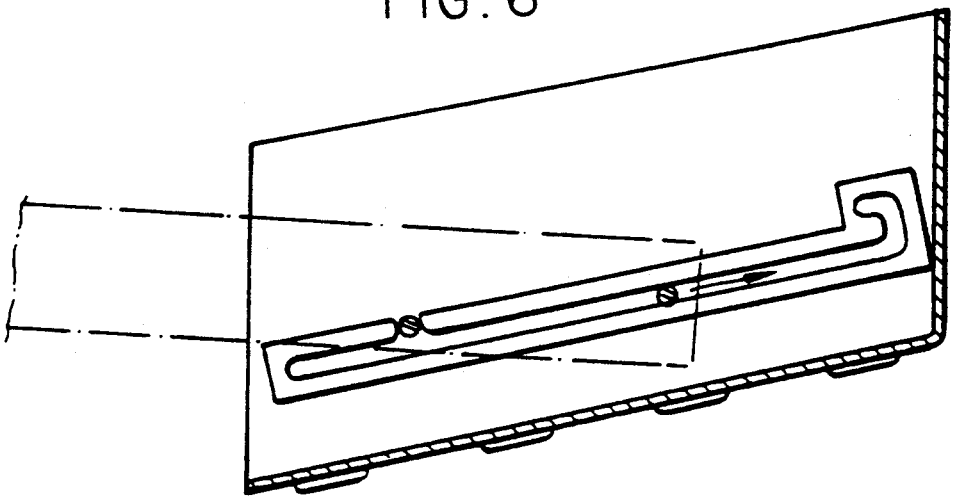

Referring more particularly to FIG. 4, the rear hooked part of the slot is such that when the tray reaches the rear abutment, indicated by position 13' of rear pin 13 and corresponding position 11' of front pin 11, it can tilt about the line of front pins 11 as an axis or fulcrum such that the rear pins rise into "hooks" 21 along an arc as shown, of radius equal to the fore-and-aft distance between the transverse lines 11,12 and 13,14. When the rear pins reach the top of the hooks the tray can be pulled or allowed to move slightly forward in order to bring the rear pins to positions 13'' corresponding to position 11'' of the front pins. The tray is thereby locked in its ordinary or "use" position. When it needs to be replenished, it is pushed slightly backwards such that rear pins are retracted into the vertical part of the hooked slot enabling the tray to tilt or be turned slightly clockwise (as viewed in the direction of FIG. 4) thereby bringing pins 13,14 to the position indicated by 13', whence the tray is clearly free to slide forwardly.

Advantageously the centre of mass of the tray is forward of the line of the front pins so that when the tray is pushed to the rearmost limit of its travel i.e. when the back pins reach the position 13' in FIG. 4, the tendency of the tray to tilt anticlockwise under gravity, about the line of front pins 11' as axis, will cause the back pins to enter the return part 21 of the slot 15. To facilitate this, part 21 may be arcuate i.e. "radiused" by R indicated by the arrow in FIG. 4, equal to the distance between the lines of the front and back pins.

If necessary the line of front pins may be forward of the centre of gravity of the tray, in which case it may be desirable for the return or hooked parts of the slot to be directed downwardly, rather than upwardly as illustrated. However in most instances the centre of mass of the tray (including anything in it) will be well forward.

In use, referring particularly to the form of the invention illustrated, assuming the tray to be in its normal position and having to be re-stocked, it may suffice to lift the front of the tray, which thereby turns clockwise about the line 11' as axis so that pins 13 reach position 13' from which the tray can be slid forwards until pins 11 abut against the lower ends of the slots.

As a preliminary to this movement, depending upon the actual configuration of the rear extremity of the slots, it may be necessary to give the tray a slight rearward push to bring pins 13 into the arcuate or "radiused" portions of the slots to enable gravity to tilt the tray so as to bring the back pins to positions 13'.

To return the tray to its normal position it suffices simply to push it back until the back pins reach position 13', to allow gravity to tilt the tray about pins 11 (in position 11') as "fulcrum" so that the front drops and back pins 13 move upwardly, and finally, if necessary, to pull the tray forwardly to engage the back pins in position 13''.

Although the pins and slots have been described as belonging to the tray and cabinet module respectively, it will be clear that this situation can be reversed if desired.

It will be evident from the foregoing that our invention provides a very convenient and straightforward arrangement whereby trays can be independently moved from one position to the other in a very simple manner.

Figure 3:
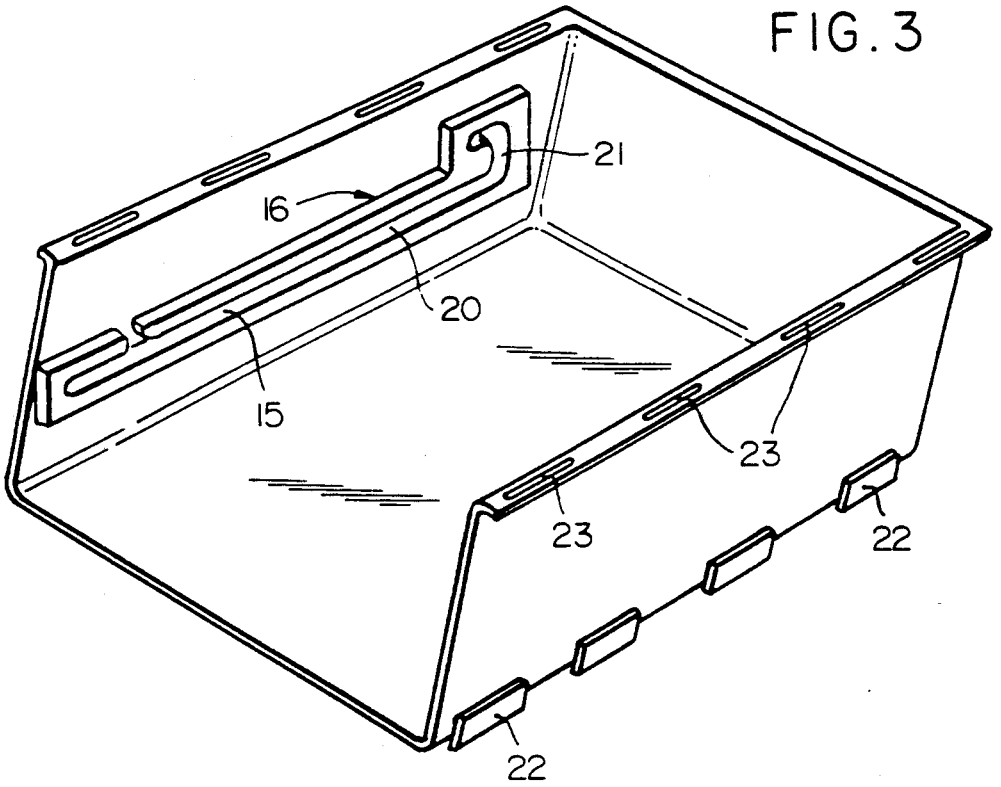

With particular reference to FIG. 3, a cabinet could comprise a bay or vertical stack of tray/module units according to the invention, or a number bays side-by-side, tongues 22 on the base of one unit being received in recesses 23 of the unit next below. Suitable top, bottom and/or side members can be provided for the cabinet. For example a single base could be provided for a number of juxtaposed bays, likewise a single top—which might incorporate suitable lighting and signage for the displayed merchandise.

A solid base (not illustrated) could be of inclined desk-like configuration with its upper face at a sufficient inclination to provide the desired inclination for the trays.

Equal spacing of the tongues 22 and recesses 23 allows of considerable flexibility in stacking (or otherwise arranging) the modules or units. If desired the units could be vertically arranged, or upper units could be fitted further back over the lower units in a "leaning" or "shingled" arrangement. A wall at the rear may afford such support as is needed for non-vertical bay.

In addition to its side-tongues 22, the bottom of each module could have centrally-located tongues (not shown) receivable in centrally located apertures in a base. Additionally or alternatively to such central tongues may be pairs of tongues, jaws or the like adapted to receive an upper side edge of a unit below, thereby enabling or facilitating the provision of laterally-offset arrangements of units.

The invention is by no means limited, in its application, to the display and/or dispensing of merchandise in shops etc. A unit or stack of units could e.g. be placed, without a base, on a desk or table and used as an office stationery cabinet, or in domestic situations as a cabinet for holding articles of different kinds.

The claims defining the invention are as follows,

I claims:

1. A drawer unit for displaying articles for sale and affording convenient access thereto, comprising a first element in the form of a housing having an open forward end, a second element in the form of a drawer for receipt in the housing, elongate guide means on one of said elements and front and rear guide runner means on the other of said elements cooperable with the guide means for mounting the drawer within the housing for back and forth substantially translational movement relative to the housing, the guide means and guide runner means defining a substantially straight path of movement for the drawer downwardly inclined in a forward direction for allowing gravity to assist forward movement of the drawer from a rear first position wherein a relatively small front part of the drawer protrudes from the forward end of the housing to a forwardmost second position wherein a relatively large part of the drawer protrudes from the forward end of the housing and substantially the entire interior of the drawer is exposed and is thereby accessible for restocking, the drawer in the first position being inclined such that unrestrained articles therein slide forwardly to a position in which a foremost article is accessible for removal from the drawer, the drawer having a center of mass located forwardly of the front guide runner means, said guide means and guide runner means being cooperable under the weight of the drawer to constrain the drawer from movement along said path, said guide means having abutments defining front and rear extremities of said path and a rear end part which is branched such that when the drawer is pushed back by hand, the drawer having reached said first position tilts under its own weight about the front runner means as a fulcrum causing the rear runner means to enter said rear end part of the guide means and thereby hold the drawer against forward movement until a further action dislodges the rear runner means from said rear end part of the guide means enabling the drawer to move from the first position to the second position.

2. A unit as defined in claim 1 wherein the guide means comprises respective guide elements defining elongate slots on opposite inner side walls of the housing and the guide runner means comprises front and rear outwardly projecting pins on side walls of the drawer received in the respective slots.

3. A unit as defined in claim 2 wherein the rear end part of the guide means comprises a hooked end on each slot.

4. A unit as defined in claim 2 wherein the guide elements each have an access opening communicating with the respective slot for inserting and removing the respective pins.

5. A unit as defined in claim 1 wherein the housing includes upper and lower complimentary male and female stacking formations enabling the housing to be stacked with at least one like housing.

6. A unit as defined in claim 5 wherein said formations comprise plural tongues and corresponding apertures located along side walls of the housing enabling a pair of housings to be stacked in line and in a staggered orientation.

* * * * *